US007764870B1

(12) United States Patent
Griffith

(10) Patent No.: US 7,764,870 B1
(45) Date of Patent: Jul. 27, 2010

(54) WATER HEATER SUPPORT

(76) Inventor: Gregory A. Griffith, 19776 S. Griffith Dr., Meadville, PA (US) 16335

( * ) Notice: Subject to any disclaimer, the term of this patent is extended or adjusted under 35 U.S.C. 154(b) by 583 days.

(21) Appl. No.: 11/712,678

(22) Filed: Feb. 28, 2007

(51) Int. Cl.
*B01D 3/06* (2006.01)
*A47G 23/02* (2006.01)

(52) U.S. Cl. ..... 392/399; 248/149

(58) Field of Classification Search ..... 392/386–464; 102/40; 203/84; 208/361; 239/128–139; 248/149–188; 108/151
See application file for complete search history.

(56) References Cited

U.S. PATENT DOCUMENTS 3,519,233 A * 7/1970 Logsdon ..... 248/146
5,119,676 A * 6/1992 Bower et al. ..... 73/290 V
5,368,263 A * 11/1994 Harrison ..... 248/146
5,685,509 A * 11/1997 Harrison ..... 248/146
5,791,264 A * 8/1998 McCraney ..... 108/151
6,216,990 B1 * 4/2001 Harrison ..... 248/146

* cited by examiner

*Primary Examiner*—Daniel Robinson
(74) *Attorney, Agent, or Firm*—Richard K. Thomson

(57) ABSTRACT

A support for a water heater is constructed of a plurality of component elements including four stacks of two elements each. The first base elements can be positioned to form an approximate cylinder with the second upper elements stackable thereupon. Diametrically opposite pairs of elements are secured in position by steel bands. An elongated trough fits between pairs of adjacent stacks of elements and has laterally extending flanges which engage and support the weight of the trough upon inwardly directed ledges on adjacent component elements. The trough is designed to fit extending laterally or transversely so that it can be extended to lie beneath the spigot on the water heater to facilitate draining, as needed.

9 Claims, 5 Drawing Sheets

WATER HEATER SUPPORT

BACKGROUND AND SUMMARY OF THE INVENTION

The present invention is directed to the field of home appliances. More particularly, the present invention is directed to a support stand for conventional residential water heaters.

Conventional residential water heaters are typically installed with integral legs, no more than a couple of inches in length, to sit directly on a concrete floor, usually in a garage or basement. This poses a potential safety hazard and, in some jurisdictions, is strictly forbidden by code. One of the problems is that should a flammable liquid be spilled in the vicinity, the pilot light or electrical ignition spark can ignite the liquid causing a fire and/or possible explosion. Further, should the basement or garage be subject to flooding, the pilot light is low enough that several inches of water can extinguish the flame. If the gas valve is working properly, this poses no more than an aggravation. Should, however, the valve malfunction, the accumulation of gas in the inclosed space or, wafting throughout the home, poses an additional health and safety hazard.

An additional difficulty associated with floor mounting is that most, if not all, manufacturers recommend periodic draining of the tank to remove mineral deposits and extend the life of the water heater. The problem with the floor mounting is that drainage is inconvenient and messy, in that there is insufficient clearance to employ a bucket in the procedure and, consequently, most home owners opt not to perform this routine maintenance. As a result, the build up of residue reduces the capacity of the tank and accelerates corrosion of the interior. The full magnitude of the problem generally goes unappreciated until the unit fails.

It is the design of the present invention to provide a suitable support stand for a conventional water heater which facilitates the drainage procedure while eliminating the hazards associated with the conventional floor mount technique. The water heater support of the present invention comprises a) a plurality of component elements adapted to form a stand for a conventional water heater, each element being formed of a durable plastic material; b) means to fasten the plurality of component elements into a unit to approximate a cylinder, the unit having a rib portion on an upper surface to engage around an outside of a base of the conventional water heater. The support is made up of a group of elements positionable adjacent one another, the group preferably being four in number, and each member of the group having a first element forming a portion of the base and a second element stacked upon the base element to provide a support of the desired height. The means to fasten the plurality of components comprises two bands which engage diagonally opposite pairs of the elements to hold each opposed pair in a precise relative position vis a vis its correspondingly paired element. An upper corner of each of the four elements has a recess having a first shape and an end portion of each of the bands has a complementary shape which is bolted into the recess.

Each element of said first set of elements forming the base a) is pie-shaped, b) is hollow and, c) has a peripheral lip extending substantially around an upper edge thereof. Each element of said second set of elements which stack upon the base elements a) is pie-shaped, b) is hollow and, c) has a curved rib portion extending along at least a portion of an upper surface of its outer rounded face. An elongated trough configured to sit beneath the water heater between said plurality of component elements is provided to facilitate draining of the water heater.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
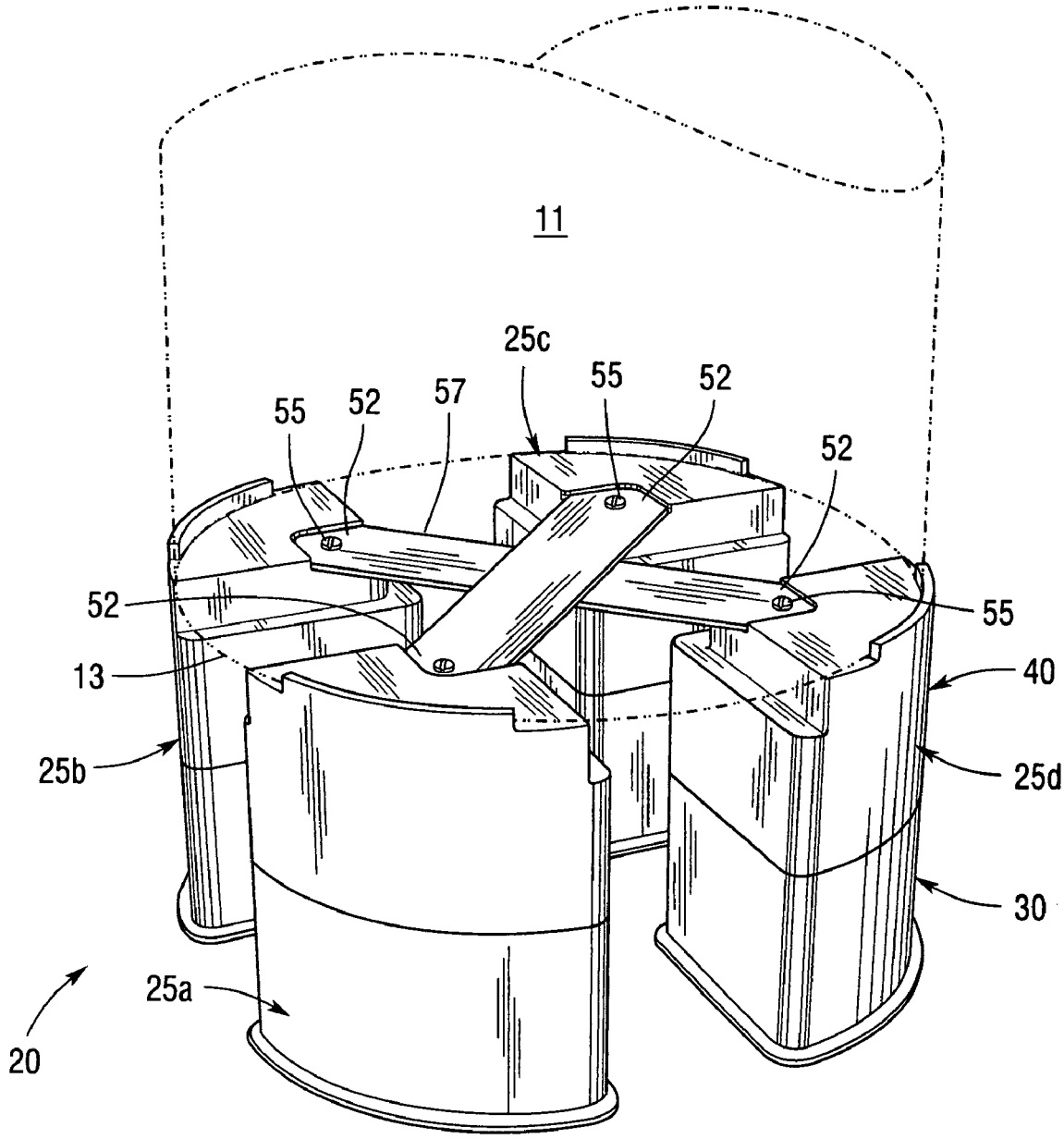
FIG. 1 is a perspective front view of a first embodiment of the water heater support of the present invention.

A first embodiment of the water heater support stand of the present invention is shown in FIG. 1 generally at 20. Water heater support 20 comprises a plurality of component elements 30, 40, each of which is made of a durable plastic material. Preferably, component elements 30, 40 are made of an injection-molded plastic resin. Suitable resins include ABS and polypropylene. The plurality of component elements 22, 24 are preferably divided into four groups 25A, 25B, 25C, and 25D which are positioned adjacent each other to approximate a cylinder (i.e., the shape of a conventional residential water heater 11).

Figure 2:
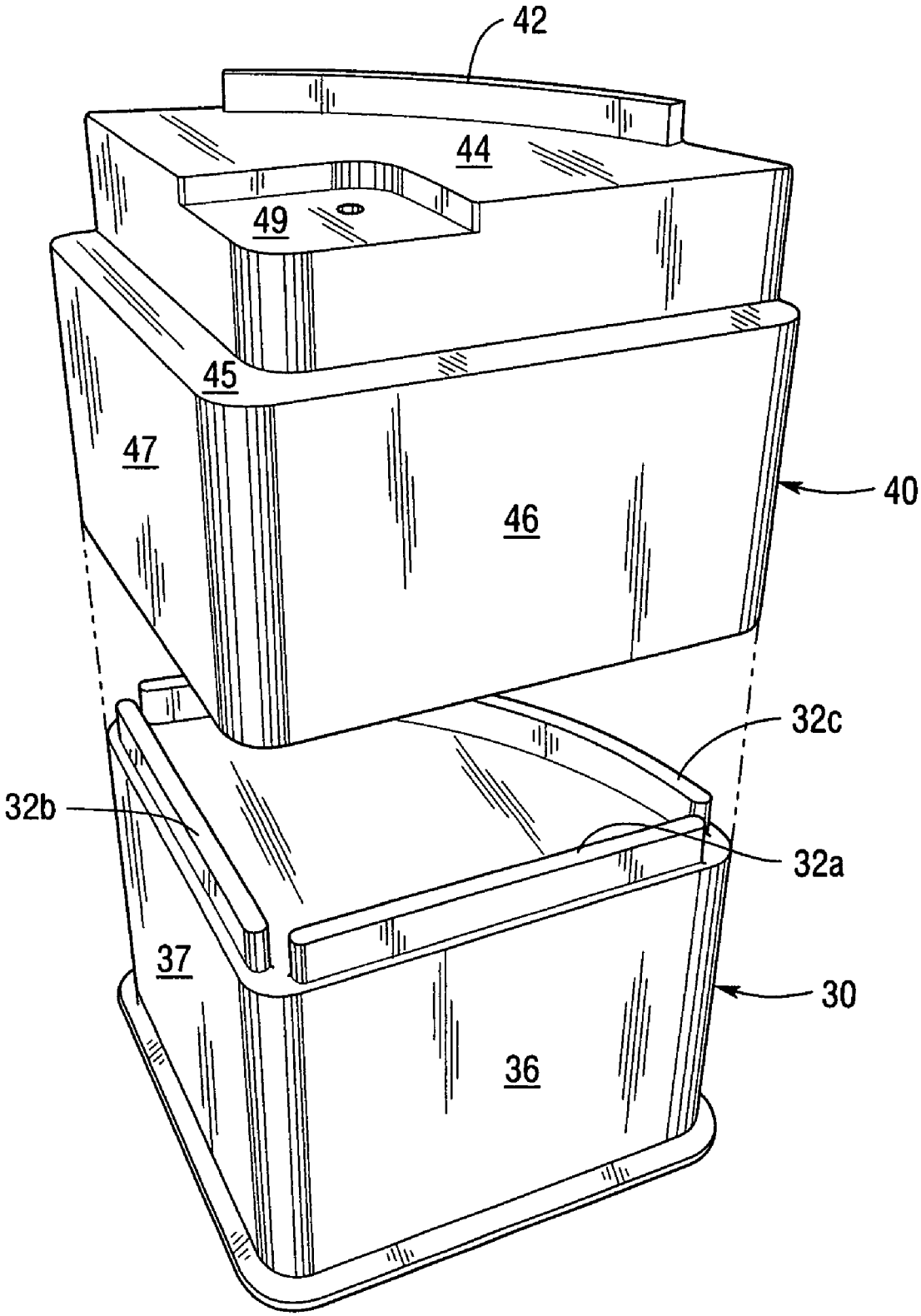
FIG. 2 is an exploded perspective view of a stack of component elements used in first embodiment.
Figure 3:
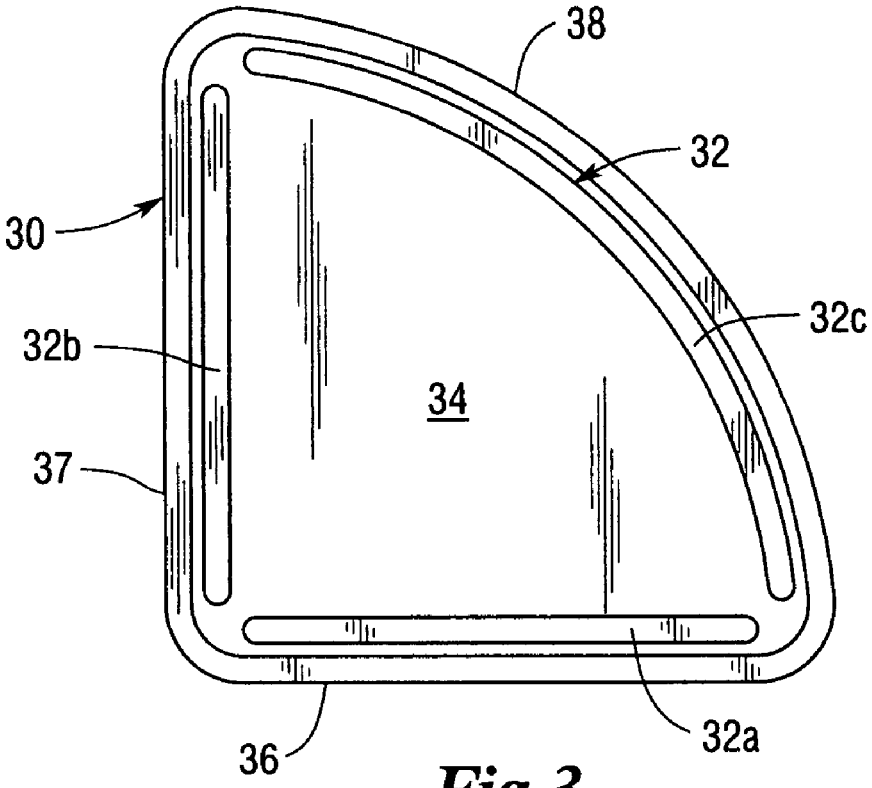
FIG. 3 is a top view of the base element used in the first embodiment.
Figure 4:
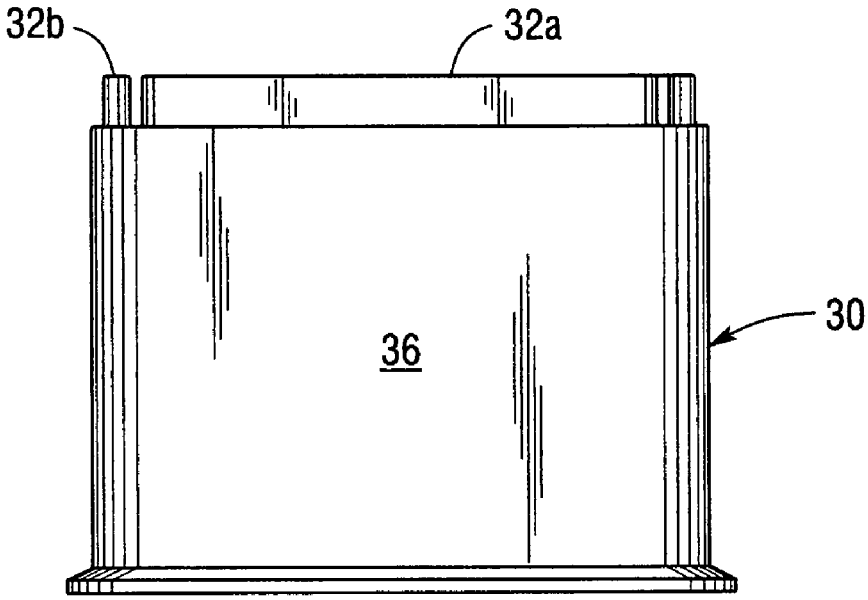
FIG. 4 is a front view of the base element shown in FIG. 3.

Each of the four groups 25A, 25B, 25C, and 25D is made up of one of a first set of component base elements 30 and one of a second set of upper elements 40 stackable thereon (FIG. 2). Base element is depicted in more detail in FIGS. 3 and 4. Each element 30 used to form the base of the water heater support 20 a) is generally pie-shaped (that is, formed in the shape of a section of a pie-wedge-shaped with an arcuate outer surface), b) is hollow and, c) has a peripheral lip 32 formed about a substantial portion of the periphery of element 30. To be more exact, lip portion 32*a* is formed on top 34 and extends parallel to, and offset from, flat front face 36. Lip portion 32*b* is formed on top 34 and extends parallel to, and offset from, flat side face 37. Lip portion 32*c* is formed on top 34 and extends parallel to, and offset from, arcuate rear face 38.

Figure 5:
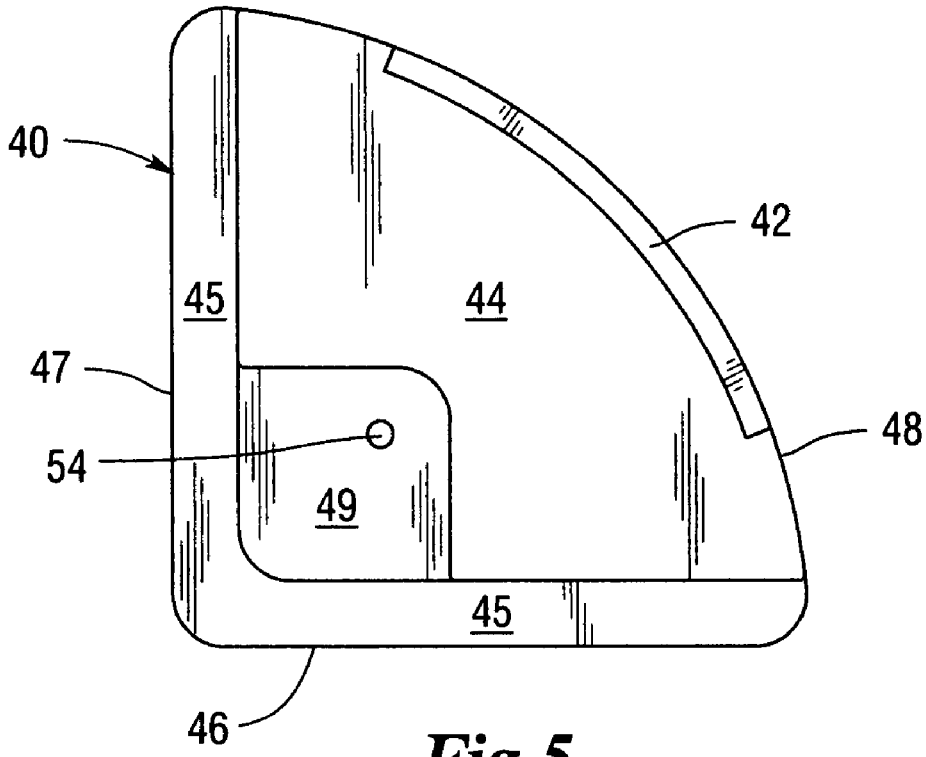
FIG. 5 is a top view of the upper element used in the first embodiment.
Figure 6:
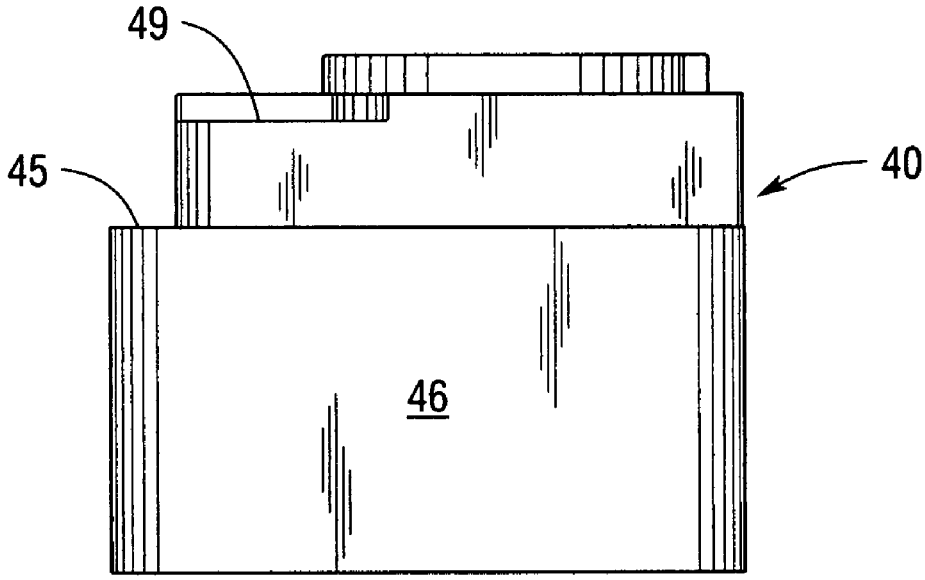
FIG. 6 is a front view of the upper element shown in FIG. 5.

Each element 40 of the second set stacked upon the base element 30 of the water heater support 20 a) is generally pie-shaped, b) is hollow and, c) has a curved peripheral rib 42 formed about a substantial portion of the arcuate periphery of element 40. To be more exact, rib portion 42 is formed on top 44 and is formed as an extension of arcuate rear face 48. Rib 42 extends around the periphery of bottom 13 of water heater 11 (FIG. 1). Flat faces 46 and 47 extend at right angles to each other and form extensions of flat faces 36, 37 when upper element 40 is stacked on base element 30. Ledge 45 extends around the inner periphery formed by flat sides 46, 47 for reasons to be discussed hereinafter. A diamond shaped recess 49 is formed in the corner between flat faces 46, 47 (FIG. 5). Two bands 50 each have a pair of pointed ends 52 which form complementary shapes for fitting in recesses 49. Bands 50 are preferably made of steel and secure diagonally opposite pairs of groups of elements 25A and 25C, 25B and 25D, respectively, against movement so the groups form a unit which has a substantially cylindrical shape. Holes 54 are formed in top 44 in diamond-shaped recess 49 to receive threaded fasteners 55 which pass through aligned holes (not shown) to bolt bands 50 in recesses 49 and to hold each pair of elements 25A and 25C, 25B and 25D, in a precise relative position vis a vis its correspondingly paired element.

Figure 7:
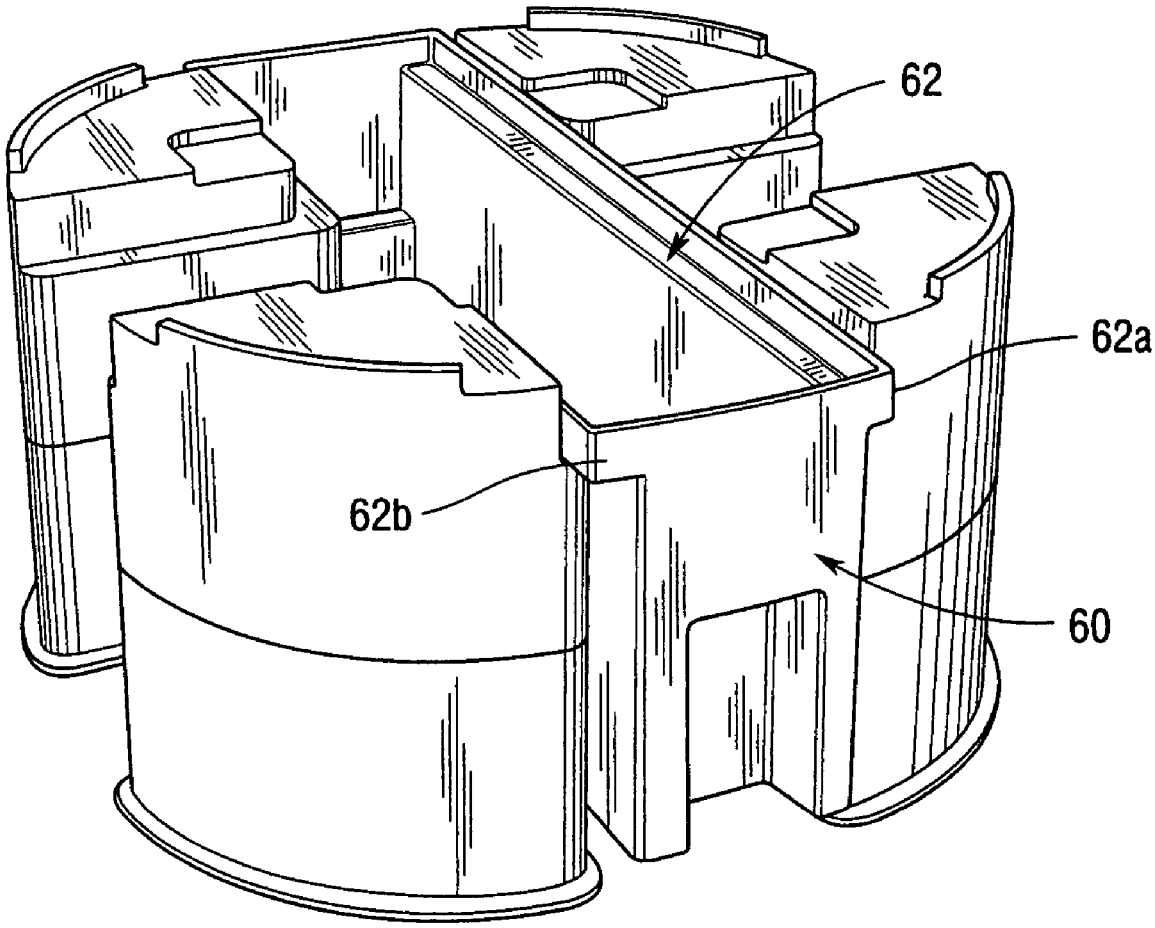
FIG. 7 is a front perspective view of the first embodiment shown with a trough for facilitating drainage.

As best seen in FIG. 7, water heater support 20 is designed for use with a bucket or trough 60 which has a lip 62 which extends about its upper periphery effectively creating laterally extending flanges 62A and 62B which sit on ledge 45 of elements 40. Trough 60 can be positioned to extend in either orthogonal direction and, preferably, the water heater will be seated atop water heater support 20 so that the trough 60 can simply be slid longitudinally out to a point where the spigot of the water heater 11 discharges directly thereto.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A water heater support comprising a) a plurality of identically shaped, wedge-shaped component elements adapted to form a stand for a conventional water heater, each element being formed of a durable plastic material;

b) means to fasten said plurality of identically shaped, wedge-shaped component elements into a unit to form a cylinder, said unit having a rib portion on an upper surface to engage around an outside of a base of the conventional water heater.

2. The water heater support of claim 1 wherein said plurality of component elements includes a group of identically shaped, wedge-shaped elements positionable adjacent one another to form said unit.

3. The water heater support of claim 2 wherein said group includes four identically shaped, wedge-shaped elements and said means to fasten said plurality of components comprises two bands which engage diagonally opposite pairs of said wedge-shaped elements to hold each pair in a precise relative position vis a vis its correspondingly paired element.

4. The water heater support of claim 3 wherein an upper corner of each of said four identically shaped, wedge-shaped elements has a recess having a first shape and an end portion of each of said bands has a complementary shape which is bolted into said recess.

5. The water heater support of claim 3 wherein each of said identically shaped, wedge-shaped group of elements includes one of a first set of base elements configured to form a base and one of a second set of upper elements stackable upon said first set.

6. The water heater support of claim 5 wherein each element of said first set of elements a) is wedge-shaped with an arcuate outer surface, b) is hollow and, c) has a peripheral lip extending around an upper edge of said arcuate outer surface.

7. The water heater support of claim 6 wherein each element of said second set of elements a) is wedge-shaped with an arcuate outer surface, b) is hollow, c) has an open bottom surface dimensioned to fit over said peripheral lip of its corresponding element of said first set, and d) has a curved rib portion extending along at least a portion of an upper edge of its arcuate outer surface.

8. The water heater support of claim 2 further comprising an elongated trough configured to sit beneath the water heater between said plurality of component elements to facilitate draining of the water heater.

9. The water heater support of claim 8 wherein said elongated trough has a pair of laterally extending flanges adapted to engage a pair of inwardly directed ledges, one on each of said elements positioned adjacent one another.

* * * * *